US009526998B2

(12) United States Patent
Hudson et al.

(10) Patent No.: US 9,526,998 B2
(45) Date of Patent: Dec. 27, 2016

(54) SPINNING TOY WITH TRIGGER ACTUATED STOP MECHANISM

(71) Applicant: JAKKS Pacific, Inc., Malibu, CA (US)

(72) Inventors: Jon Hudson, Woodland Hills, CA (US); Dominic Laurienzo, Los Angeles, CA (US); Jared Wolfson, Calabasas, CA (US); Jeremy Padawer, Pacific Palisades, CA (US); Dennis Lee Chi Wai, Hong Kong (CN); Timmy Tsui Ka Tim, Hong Kong (CN); Jim McCafferty, San Clemente, CA (US); Greg Leong, Irvine, CA (US); Steven Douglas DeLacy, Santa Ana, CA (US)

(73) Assignee: JAKKS Pacific, Inc., Santa Monica, CA (US)

( * ) Notice: Subject to any disclaimer, the term of this patent is extended or adjusted under 35 U.S.C. 154(b) by 308 days.

(21) Appl. No.: 13/678,958

(22) Filed: Nov. 16, 2012

(65) Prior Publication Data

US 2013/0072084 A1 Mar. 21, 2013

Related U.S. Application Data

(63) Continuation-in-part of application No. 12/798,576, filed on Apr. 6, 2010, and a continuation-in-part of application No. 13/179,432, filed on Jul. 8, 2011.

(Continued)

(51) Int. Cl.

| | |
|---|---|
| ***A63H 1/00*** | (2006.01) |
| ***A63H 17/02*** | (2006.01) |
| *A63H 1/24* | (2006.01) |

(52) U.S. Cl.

CPC . *A63H 1/00* (2013.01); *A63H 1/24* (2013.01); *A63H 17/02* (2013.01)

(58) Field of Classification Search

CPC ..... A63H 1/00; A63H 17/00; A63H 17/004; A63H 17/02; A63H 17/26; A63H 29/00; A63H 29/22; A63H 33/00; A63H 33/005; A63H 33/26; B62D 61/00; B62D 61/02; B62D 21/04

(Continued)

(56) References Cited

U.S. PATENT DOCUMENTS

| | | | |
|---|---|---|---|
| 1,609,336 | A | 12/1926 | Ward |
| 2,546,896 | A | 3/1951 | Kassuba |

(Continued)

FOREIGN PATENT DOCUMENTS

| | | |
|---|---|---|
| GB | 436912 | 10/1935 |
| JP | 55078982 A | 6/1980 |
| WO | 2006/133069 | 12/2006 |

OTHER PUBLICATIONS

PCT Intenational Search Report and the Written Opinion of the International Searching Authority for PCT/US2012/065702.

(Continued)

*Primary Examiner* — Gene Kim
*Assistant Examiner* — Alyssa Hylinski
(74) *Attorney, Agent, or Firm* — Tope-McKay & Associates

(57) ABSTRACT

A perpetual spinning toy is described. The spinning toy includes a body component and a motor housed within the body component. A power source is housed within the body component and electrically connected with the motor. Finally, a spinning wheel is connected with the motor. Thus, when the motor is activated, the motor spins the spinning wheel, thereby causing the toy to spin. The toy also includes an impact trigger and stop mechanism, both of which are connected with the body component. The stop mechanism is also operably connected with the impact trigger. The stop (Continued)

mechanism includes a latch that is connected with the impact trigger and a plurality of spring-loaded wings that are pivotally connected with the body component, such that upon impacting the impact trigger, the wings are released from the catch, causing them to swing outward.

5 Claims, 8 Drawing Sheets

Related U.S. Application Data

(60) Provisional application No. 61/212,065, filed on Apr. 6, 2009, provisional application No. 61/212,084, filed on Apr. 6, 2009, provisional application No. 61/212,085, filed on Apr. 6, 2009, provisional application No. 61/212,064, filed on Apr. 6, 2009, provisional application No. 61/363,069, filed on Jul. 9, 2010, provisional application No. 61/421,173, filed on Dec. 8, 2010, provisional application No. 61/561,213, filed on Nov. 17, 2011.

(58) Field of Classification Search
USPC ..... 446/4, 6, 236, 242, 431, 457, 465, 470
See application file for complete search history.

(56) References Cited

U.S. PATENT DOCUMENTS 2,631,405 A 3/1953 Masten
2,683,603 A 7/1954 Gackenbch
2,692,455 A 10/1954 Frmpton
2,783,046 A 2/1957 Lien
2,788,613 A 4/1957 Gelfand
2,988,949 A 6/1961 Rohmann
3,018,584 A 1/1962 Passariello
3,068,851 A 12/1962 Geer, Jr.
3,139,697 A 7/1964 Mier
3,392,482 A 7/1968 Gerd
3,451,671 A 6/1969 May
3,492,760 A 2/1970 Nishitani
3,528,659 A 9/1970 Benham
3,538,620 A 11/1970 Kohner
3,555,725 A * 1/1971 Orfei et al. ..... A45D 24/32 180/10
3,687,452 A 8/1972 Thompson
3,726,019 A * 4/1973 Adler ..... A63H 13/15 33/18.1
3,803,757 A 4/1974 Sanchez
3,949,990 A 4/1976 Polonyi
4,059,089 A 11/1977 Lehman
4,118,888 A 10/1978 Ogawa
4,203,247 A 5/1980 Moe et al.
4,310,987 A * 1/1982 Chieffo ..... A63H 29/22 446/175
4,319,751 A 3/1982 Kurushima et al.
4,455,781 A 6/1984 Blumenthal
4,466,214 A * 8/1984 Kulesza ..... A63H 17/02 446/437
4,689,034 A 8/1987 Dubois et al.
4,737,135 A 4/1988 Johnson et al.
4,886,273 A 12/1989 Unger
4,946,413 A 8/1990 Lehmann et al.
5,092,807 A 3/1992 Lew et al.
5,122,089 A 6/1992 Haran
5,154,657 A 10/1992 Wildman et al.
5,169,354 A 12/1992 Norton et al.
5,238,440 A 8/1993 Morin
5,290,041 A 3/1994 Kettelson
5,314,338 A 5/1994 Caveza et al.
5,380,231 A 1/1995 Brovelli
5,419,706 A 5/1995 Levy et al.
5,453,036 A 9/1995 Wisznia
5,593,338 A 1/1997 Itoh et al.
5,683,284 A 11/1997 Christen
5,746,640 A 5/1998 Meadows
5,810,638 A 9/1998 Wood
5,871,386 A * 2/1999 Bart ..... A63H 15/06 446/443
5,916,007 A 6/1999 Maxim
5,941,753 A 8/1999 Diresta
5,989,092 A 11/1999 McGowan et al.
6,086,449 A 7/2000 Sharp
6,171,169 B1 1/2001 Saunders
6,312,306 B1 11/2001 Kroll
6,354,842 B1 * 3/2002 Frei ..... A63H 17/25 434/258
6,364,734 B1 4/2002 Ng
6,458,008 B1 10/2002 Hyneman
6,485,017 B1 11/2002 Ng
6,502,657 B2 * 1/2003 Kerrebrock ..... B25J 9/08 180/218
6,530,817 B1 3/2003 Winslow et al.
6,533,638 B1 3/2003 Nelson et al.
6,540,577 B1 4/2003 Nelson et al.
6,548,982 B1 * 4/2003 Papanikolopoulos . B62D 57/02 318/568.11
6,592,426 B2 7/2003 Mesch
6,592,427 B1 7/2003 Wilhelm et al.
6,612,895 B2 9/2003 Sze
6,626,729 B2 9/2003 Osawa
6,648,647 B2 11/2003 Wood et al.
6,761,612 B1 7/2004 Pencil et al.
6,764,374 B2 * 7/2004 Tilbor ..... A63H 17/262 446/233
6,860,346 B2 * 3/2005 Burt ..... B60B 15/00 180/218
6,860,787 B1 3/2005 Woodhouse
6,988,927 B2 1/2006 Gingold et al.
7,056,185 B1 6/2006 Anagnostou
7,063,589 B2 6/2006 Matsukawa et al.
7,086,109 B2 8/2006 Fisher et al.
7,140,945 B2 11/2006 Dinhofer
7,168,723 B2 1/2007 de Oliveira
7,427,225 B2 9/2008 Matsukawa et al.
7,591,471 B2 9/2009 Walterscheid
7,731,563 B2 6/2010 Saucier
7,785,168 B2 8/2010 Yamada et al.
7,803,033 B1 9/2010 Walterscheid
7,874,892 B2 1/2011 Hippely
7,927,177 B1 4/2011 Walterscheid
8,197,298 B2 * 6/2012 Willett ..... A63H 17/02 446/164
8,568,191 B2 10/2013 Rehkemper et al.
8,734,276 B2 * 5/2014 Laurienzo ..... A63H 33/18 473/578
2002/0011368 A1 1/2002 Berg
2002/0102903 A1 8/2002 Coleman
2002/0137428 A1 * 9/2002 Tilbor ..... A63H 17/262 446/465
2002/0164921 A1 11/2002 Wilkinson et al.
2003/0129920 A1 7/2003 Sze
2003/0137268 A1 7/2003 Papanikolopoulos et al.
2006/0260594 A1 11/2006 Andersen
2007/0021029 A1 1/2007 Weidetz et al.
2007/0117492 A1 5/2007 Sze et al.
2007/0117494 A1 5/2007 Sheller
2007/0178996 A1 8/2007 Fenn
2007/0205554 A1 9/2007 Elliott
2008/0277374 A1 11/2008 Miura
2009/0075557 A1 * 3/2009 Arriola ..... A63H 17/268 446/438
2010/0255752 A1 10/2010 McCafferty et al.

OTHER PUBLICATIONS

PCT Intenational Preliminary Report on Patentability from PCT/US2012/065702, mailed on May 30, 2014.

PCT Intenatonal Preliminary Report on Patentability for PCT/US2011/001202.

(56) References Cited

OTHER PUBLICATIONS

Office Action 1 for U.S. Appl. No. 13/179,432. Date mailed: Jun. 26, 2013.
Office Action 1 Response for U.S. Appl. No. 13/179,432. Date mailed: Sep. 26, 2013.
Office Action 2 for U.S. Appl. No. 13/179,432. Date mailed: Dec. 16, 2013.
Office Action 2 Response for U.S. Appl. No. 13/179,432. Date mailed: Apr. 15, 2014.
Office Action 3 for U.S. Appl. No. 13/179,432. Date mailed: Jun. 27, 2014.
Office Action 3 Response for U.S. Appl. No. 13/179,432. Date mailed: Sep. 29, 2014.
Office Action 4 for U.S. Appl. No. 13/179,432. Date mailed: Oct. 21, 2014.
Office Action 4 Response for U.S. Appl. No. 13/179,432. Date mailed: Jan. 21, 2015.
Notice of Allowance for U.S. Appl. No. 13/179,432. Date mailed: Jun. 5, 2015.
Office Action 1 for U.S. Appl. No. 12/798,576. Date mailed: Jan. 12, 2012.
Office Action 1 Response for U.S. Appl. No. 12/798,576. Date mailed: Apr. 12, 2012.
Office Action 2 for U.S. Appl. No. 12/798,576. Date mailed: May 7, 2012.
Office Action 2 Response for U.S. Appl. No. 12/798,576. Date mailed: Aug. 20, 2012.
Office Action 3 for U.S. Appl. No. 12/798,576. Date mailed: Apr. 10, 2014.
Paul Doherty, Spinning Cylinder, Jan. 7, 2006, pp. 1-3. <http://www.exploratorium.edu/snacks/spinning_cyl/>.
Office Action 3 Response for U.S. Appl. No. 12/798,576. Date mailed: Jul. 2, 2014.
Office Action 4 for U.S. Appl. No. 12/798,576. Date mailed: Oct. 21, 2014.

* cited by examiner 100
100
100

SPINNING TOY WITH TRIGGER ACTUATED STOP MECHANISM

CROSS REFERENCE TO RELATED APPLICATIONS

This is a Continuation-in-Part of Ser. No. 12/798,576, filed on Apr. 6, 2010, and entitled, "Spinning Toy," which is a Non-Provisional Utility Patent Application of U.S. Provisional Application Nos. 61/212,065, 61/212,084, 61/212,085, and 61/212,064, all of which were filed on Apr. 6, 2009.

This is ALSO a Continuation-in-Part of Ser. No. 13/179,432, filed on Jul. 8, 2011, and entitled, "Core with Finger Indentation and Formed to Expel an Object Concealed Therein," which is a Non-Provisional Utility Patent Application of U.S. Provisional Application Nos. 61/363,069, filed on Jul. 9, 2010, and entitled, "Shell for expelling an object concealed therein," and 61/421,173, filed on Dec. 8, 2010, entitled, "Shell with Finger Indentation."

This is ALSO a Non-Provisional Utility Patent Application of U.S. Provisional Application No. 61/561,213, filed on Nov. 17, 2011, and entitled, "Spinning Toy with Trigger Actuated Stop Mechanism."

BACKGROUND OF THE INVENTION (1) Field of Invention

The present invention relates to a spinning toy and, more particularly, to toy that includes an externally spinning wheel that engages with a ground surface to cause a body component to spin perpetually until an impact trigger is impacted.

(2) Description of Related Art

Spinning tops have long been known in the art. A traditional spinning top is formed with a bulbous top and a single point upon which the top spins. Such tops are typically spun by pulling a string or other item that causes the top to rotate at a high rate of rotation, thereby providing the top with the traditional "spin."

Alternatively, U.S. Pat. No. 3,018,584 (the '584 patent) describes a pinch-spin top, which is spun through the use of a. pinching, device. The top itself includes a ridge that runs around the circumference of the top. The pinching device can be positioned within the ridge and squeezed to shoot the top from the device, thereby causing the pinch-spin top to spin.

Another variation of the traditional top can be found in U.S. Pat. No. 5,122,089 (the '089 patent), which describes a spin top that includes a cylindrical body of substantially rotational symmetry around a longitudinal axis, with a pointed end face along the axis. The '089 patent describes a foot board (i.e., pinching device) that rests against the cylindrical body and that can be stomped upon to pinch the body from the foot board, causing the top to spin.

Thus, while both the '089 patent and the '584 patent teach a form of a pinch-spin top, they both rely upon a pinching device.

The action of a traditional top and the tops described above relies on the gyroscopic effect for its operation. Typically the top will at first wobble until the shape of the tip and its interaction with the surface force it upright. After spinning upright for an extended period, the angular momentum and, therefore, the gyroscopic effect, will gradually lessen. This leads to an ever increasing precession which finally causes the top to topple in a frequently violent last thrash.

Although enjoyable while the spinning motion continues, typical tops ultimately topple as the angular momentum decreases. Thus, a continuing need exists for a spinning toy that continues to spin perpetually.

SUMMARY OF INVENTION

A perpetual spinning toy is described. The spinning toy includes a body component and a motor housed within the body component. A power source is housed within the body component and electrically connected with the motor. Finally, a spinning wheel is connected with the motor. Thus, when the motor is activated, the motor spins the spinning wheel, thereby causing the toy to spin. The toy also includes an impact trigger and stop mechanism, both of which are connected with the body component. The stop mechanism is also operably connected with the impact trigger.

In another aspect, the stop mechanism includes a plurality of spring-loaded wings that are pivotally connected with the body component and a catch (e.g., wing catch) that is adapted to hold the wings against the body component. The catch is operably connected with the impact trigger, such that upon impacting the impact trigger, the wings are released and allowed to swing outward to a deployed state.

Finally, as can be appreciated by one in the art, the present invention also comprises a method for forming and using the spinning toy described herein.

BRIEF DESCRIPTION OF THE DRAWINGS

The objects, features and advantages of the present invention will be apparent from the following detailed descriptions of the various aspects of the invention conjunction with reference to the following drawings, where.

DETAILED DESCRIPTION

The present invention relates to a spinning toy and, more particularly, to toy that includes an externally spinning wheel that engages with a ground surface to cause a body component to spin perpetually until an impact trigger is impacted. The following description is presented to enable one of ordinary skill in the art to make and use the invention and to incorporate it in the context of particular applications. Various modifications, as well as a variety of uses in different applications will be readily apparent to those skilled in the art, and the general principles defined herein ma be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

Figure 1:
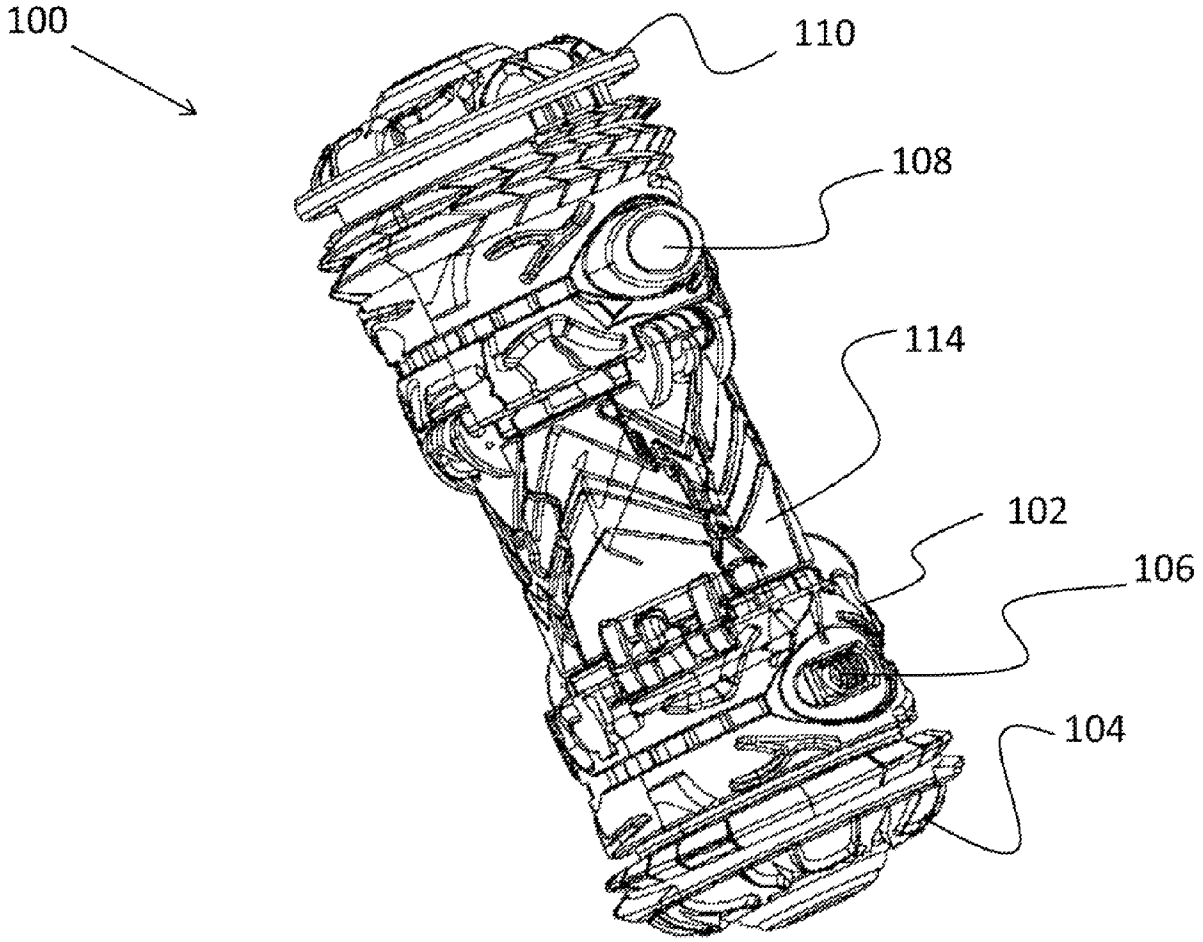
FIG. 1 is an illustration a spinning toy according to the present invention.
Figures 2A, 2B, 2C, 2D, 2E, 2F:
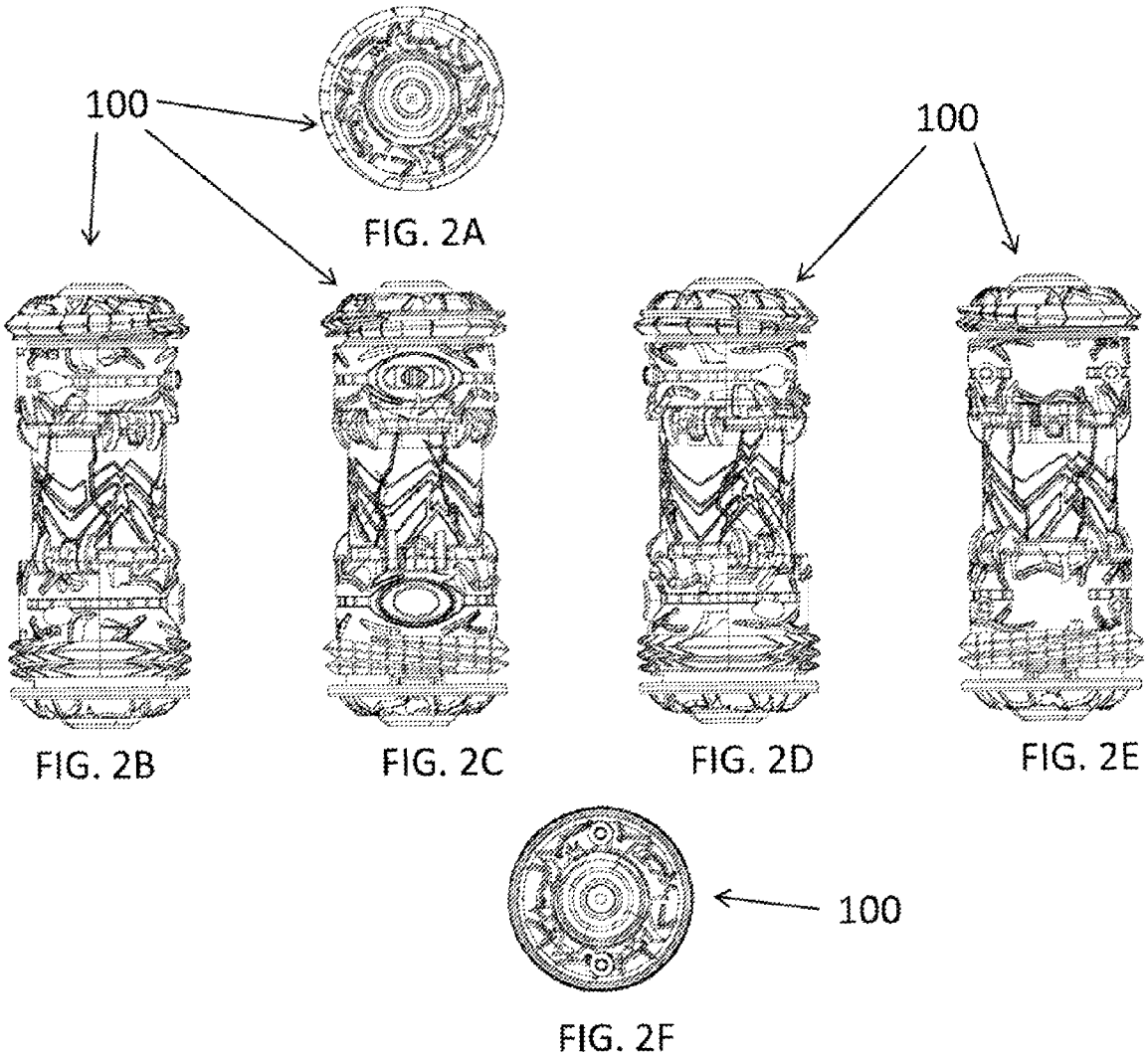
FIG. 2A is a top-view illustration of the spinning toy according to the present invention.
FIG. 2B is a left, side-view illustration of the spinning, toy according to the present invention.
FIG. 2C is a front-view illustration of the spinning toy according to the present invention.
FIG. 2D is a right, side-view illustration of the spinning toy according to the present invention.
FIG. 2E is a back-view illustration of the spinning toy according to the present invention.
FIG. 2F is a bottom-view illustration of the spinning toy according to the present invention.

As shown in FIG. 1 the present invention relates to a spinning toy 100 with a trigger actuated stop mechanism. In one aspect, the spinning toy 100 is generally cylindrically-shaped without substantially rounded ends. It should be understood that although the spinning toy 100 is described as being generally cylindrically-shaped, the present invention is not intended to be limited thereto as it can be formed in any other shape to allow for the rotational operations as described herein.

The spinning toy 100 includes a body component 102 and a spinning wheel 104. The toy 102 is formed in any suitable shape to spin when the spinning wheel 104 is spinning. As a non-limiting, example, the body component 102 is formed as a cylinder with a diameter that is similar to that of the spinning wheel 104. In another aspect, the body component 102 is formed as a cylinder and the spinning wheel 104 is formed with a diameter that is greater than that of the body component 102.

The body component 102 houses an electric motor that includes an axle which extends from the body component 102 and is connected to the spinning wheel 104. Thus, the electric motor is used to rotate the spinning wheel 104. A power source is included in the body component 102 to power the motor. The power source is any suitable mechanism or device capable of storing electricity and powering the motor, non-limiting examples of which include a battery (e.g., three 1.5V button cell batteries) and a capacitor.

A switch 106 is included to allow a user to selectively turn the toy off and on. The switch 106 is any suitable mechanism or device that is operable for selectively completing a circuit and providing power from the power source to the motor, on-limiting examples of which include a slide switch (illustrated as elements 26 and 27 in FIG. 3), a motion switch, and a centrifugal switch.

The toy 100 can be formed in any suitable size, a non-limiting example of which is between 2 and 5 inches in length and, desirably, approximately 3.25 inches in length. As another example, the toy has a diameter between 0.5 and 2 inches and, desirably, is approximately 1.25 inches. The body component 102 (or a portion thereof) can also be formed of a translucent material, with a light (e.g., LED) therein. Thus, the On/Off switch 106 controls the spinning and the light. There is an optional launch button 108 (e.g., push switch, illustrated as elements 10 and 34 in FIG. 3), that acts as a secondary switch to the motor. Thus, in this aspect, for the motor to work and spin the spinning wheel 104, the switch 106 must be in the on position and the launch button 108 must be depressed. The launch button 108 can be formed as a finger indentation to allow a user to press down on the launch button 108 and pull their hand in a back-spin motion, which causes the spinning toy 100 to launch and then spin continuously due to the rotational motion of the spinning wheel 104. Alternatively, a user can simply turn on the switch 106 and depress the launch button 108 which causes the spinning wheel 104 to spin, resulting in the spinning toy 100 spinning continuously upon a surface.

To enhance game play, the spinning toy 100 can be used as a target. In other words, it may be desirable to initiate the spin of the spinning toy 100 and then launch or shoot items at it. For example, other spinning toys, such as those described in U.S. patent application Ser. Nos. 12/798,576 and 13/179,432, can be launched at the spinning toy 100 of the present invention.

To provide feedback to the user and allow users to compete or play a game using the spinning toy 100, the spinning toy 100 includes a trigger actuated stop mechanism. Thus, the spinning toy 100 stops spinning when another item impacts it. As a non-limiting example, there is an impact trigger 110 on one end of the spinning toy 100 that causes the toy 100 to stop spinning. On the other end of the toy 100 is the motorized spinning wheel 104. Once the impact trigger 110 is hit by an opponent launching an item at it, it causes the toy 100 to stop spinning by opening the circuit to the motor, which causes the spinning wheel 104 to stop spinning.

Figure 3:
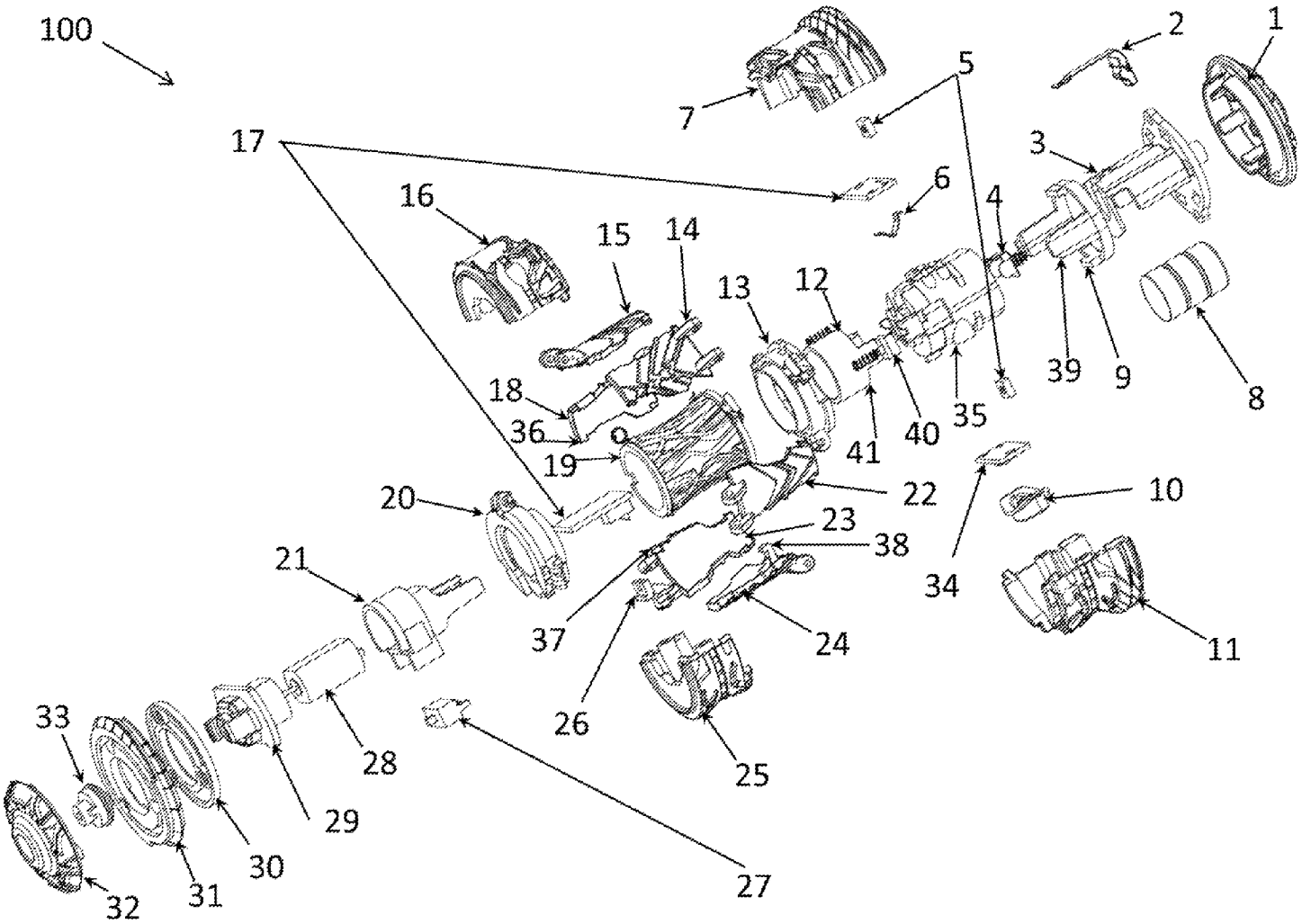
FIG. 3 is an exploded-view illustration of the toy.

Further, to rapidly and immediately decelerate and stop the spin, the toy 100 includes a stop mechanism. The stop mechanism is any suitable mechanism or device that, upon actuating the impact trigger 110, causes the device to immediately stop its spin. As a non-limiting example, the stop mechanism includes wings 114 that swing out to change the profile of the toy 100 and, thereby, cause the toy 100 to immediately change its engagement with a surface and stop spinning. The wings 114 can be formed of any suitable material. For example, the can be formed of translucent plastic such that a light in the body component 102 (or middle casing 19, as depicted in FIG. 3) can be viewed through the wings 114.

As a non-limiting example, the wings 114 include six wings that are spring loaded and pivotally connected with the body component 102. Upon impacting the impact trigger, 110, the wings 114 are re leased from a catch, causing them to swing outward (i.e., the impact trigger 110 is operably connected with the stop mechanism and its wings 114). Simultaneously, a light in the middle of the body component 104 flickers. To close the wings 114, they can be folded back against the body component 104 to be locked in place against the body component.

Additional views of the toy 100 are provided in FIGS. 2A, 2B, 2C, 2D, 2E, and 2F, which illustrate top, left, front, right, back, and bottom views, respectively.

As can be appreciated by one skilled in the art and referring again to FIG. 1, there are many techniques by which the toy 100 can be formed to include a body component 102 with a spinning wheel 104 and an impact trigger 110 that, upon actuation, triggers a stop mechanism and stops rotation of the spinning wheel 104.

One specific non-limiting example of a spinning toy 100 according to the present invention is depicted in the exploded-view illustration of FIG. 1A list is provided below as a central resource for the reader to identify each component of the toy 100 with its corresponding element number as illustrated in FIG. 3. The numerals as depicted in FIG. 3 correspond to the following individual components:

1. battery compartment cover
2. negative battery plate
3. battery compartment
4. positive battery plate
5. nut
6. metal plate
7. impact trigger housing rear
8. battery
9. wings lock pusher
10. push switch knob
11. impact trigger housing from
12. wings lock cylinder
13. second wings pivot ring
14. third wing
15. fifth wing
16. slide switch housing front.
17. printed circuit board (PCB) one or multiple, as desired
18. second wing
19. middle casing
20. first wings pivot ring
21. motor housing
22. fourth wing
23. sixth wing
24. first wing
25. slide switch housing rear
26. slide switch knob
27. slide switch
28. electric motor
29. motor cover
30. spinning wheel—inner cover
31. spinning wheel tire
32. spinning wheel—outer cover
33. spinning wheel clutch
34. push switch
35. impact trigger/battery compartment
36. wing projection
37. wing recession
38. wing catch
39. wings lock pusher arm
40. wings lock cylinder tab
41. catch lip
42. middle casing opening As depicted in FIG. 3, the toy 100 includes several components that collectively form the spinning wheel, stop mechanism and impact trigger. For example, the spinning wheel is formed of a spinning wheel inner cover 30, a spinning wheel tire 31, and a spinning wheel outer cover 32. A spinning wheel clutch 33 is optionally attached with the outer cover 32 and the axle of the motor 28. When the impact trigger is activated and the stop mechanism is deployed, a PCB 17 can be optionally used to cut power to the motor 28. In an optional aspect, when the motor 28 is disengaged, the spinning wheel clutch 33 operates to stop rotation of the outer cover 32 and, thereby, the spinning wheel tire 31 and spinning wheel inner cover 30. In an alternative optional aspect, the wheel clutch 33 can operate to allow the spinning heel to rotate freely in clockwise and counterclockwise directions; however, when the motor 28 is engaged and rotates the axle and spinning wheel clutch 33, the spinning wheel clutch 33 engages to force the spinning wheel to rotate in the desired direction.

In addition to controlling lights, the PCBs can optionally be used to control various functions of the motor. As a non-limiting example, the PCBs may be used to control the amount of time that the motor is turned on.

As noted above, the stop mechanism includes wings that pivot out to stop rotation of the toy 100. For example, three wings (elements 15, 22, and 23) are pivotally connected with the first wings pivot ring 20, while three other wings (elements 14, 18, and 24) are pivotally connected with the second wings pivot ring 13. The wings can be spring-loaded with a pin and spring that pivotally connects each of the wings with the corresponding wings pivot ring to bias the wings to swing out and away from the middle casing 19. The first and second wings pivot rings 20 and 13 are connected with and sandwich the middle casing 19. When the wings are pressed against the middle casing 19, each of the wings can be locked against the middle casing 19 via, any suitable technique. For example, each wing can individually have a catch that projects into the middle casing 19 for release by the impact trigger mechanism. Alternatively and as illustrated, each wing includes a wing projection 36 that engages with a wing recession 37 on an adjacent wing. In other words, when the wings are pressed against the middle casing 19, the wings have wing projections 36 that lock against an adjacent wing by connecting with a corresponding wing recession 37. To connect the wings against the middle casing 19 and allow for actuation from the impact trigger mechanism, at least one wing includes a wing catch 18 that projects into the middle casing 19 to engage and catch against a catch lip 41 of the wings lock cylinder 12 (which is slidingly positioned within the middle casing 19).

To actuate with the wing catch 38 and deploy the wings, the toy 100 includes an impact trigger mechanism. The impact trigger includes the battery compartment cover 1, the battery compartment 3, the wings lock pusher 9, and the wings lock cylinder 12. When assembled, the battery compartment cover 1 is fixedly attached with the battery compartment 3. The battery compartment 3 is positioned through the wings lock pusher 9 and into the impact trigger/battery compartment 35. The wings lock pusher 9 is slidingly positioned around the impact trigger/battery compartment 35 and includes wings lock pusher arms 39 that extend over the impact trigger/battery compartment 35 to engage with wings lock, cylinder tabs 40 on the wings lock cylinder 12. The wings lock cylinder 12 is spring loaded and slidingly positioned through the second wings pivot ring 13 and within the middle casing 19. Thus, the wing catch 38 can be selectively attached with the catch lip 41. When the compartment cover 1 is depressed, it depresses the battery compartment 3 and wings lock pusher 9, which forces the wings lock pusher arms 39 to depress the lock cylinder tabs 40 and, thereby, release the wing catch 38. Because the wings are spring-loaded, when the wing catch 38 is released, the wings (elements 14, 15, 18, 22, 23, and 24) automatically swing out to change the profile of the spinning toy 100 and engage with the ground surface. By engaging with the ground surface, the toy 100 immediately ceases rotating.

Figure 4A:
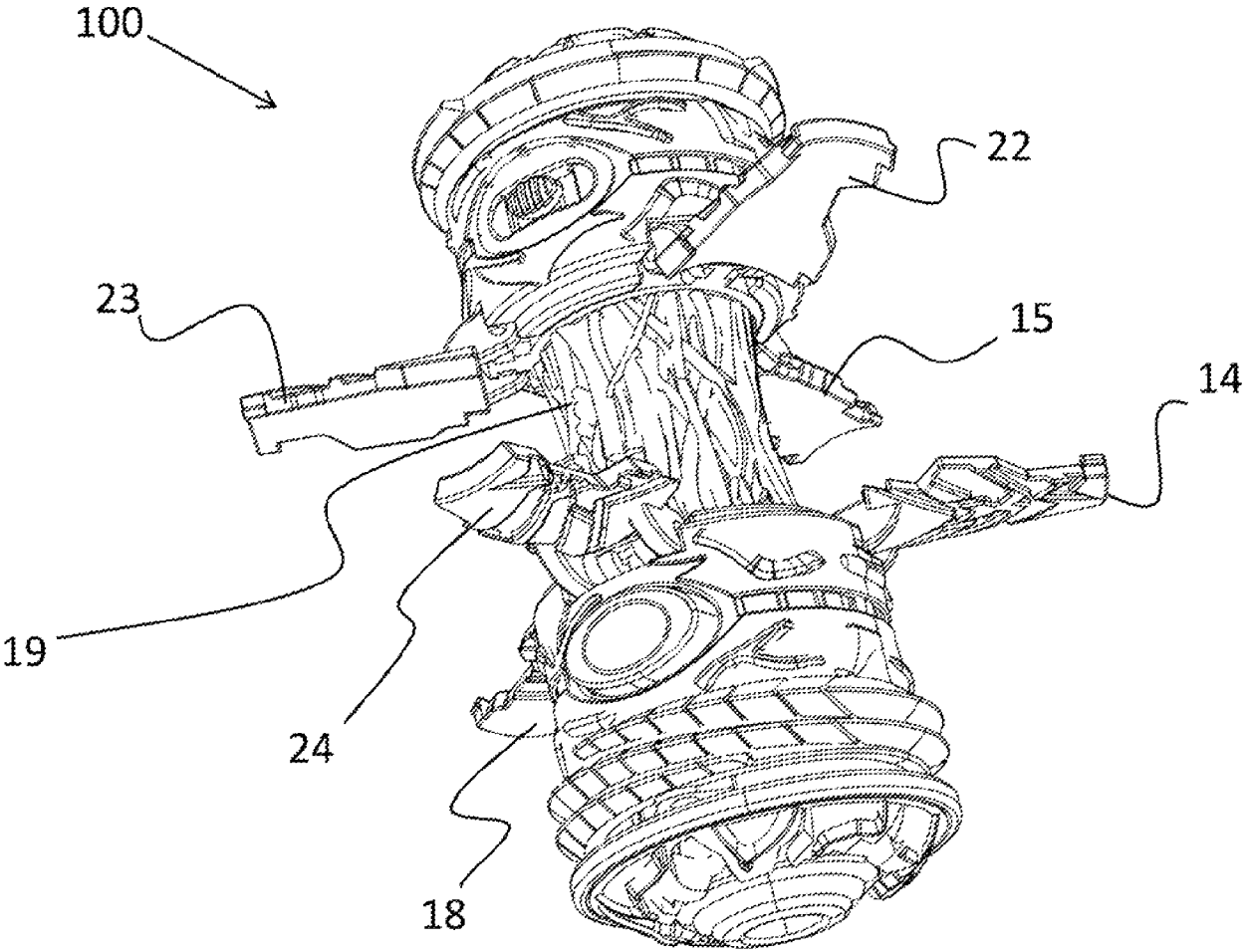
FIG. 4A is a perspective-view illustration of the toy, depicting wings in a deployed form.
Figure 4C:
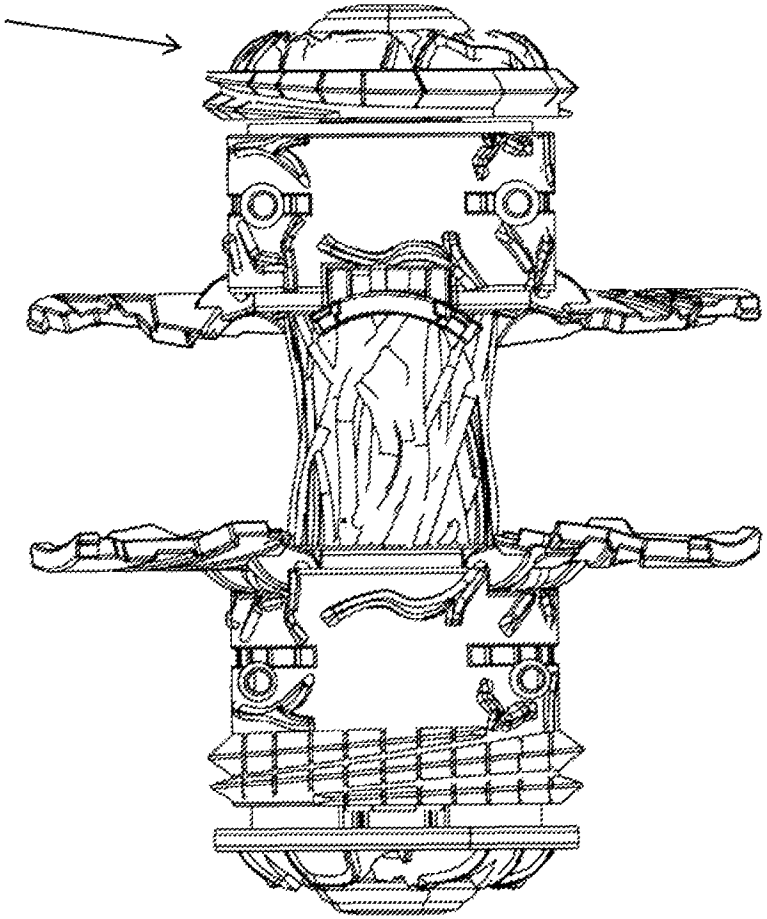
FIG. 4C is a rear-view illustration of the toy, depicting the wings in a deployed state.
Figure 4B:
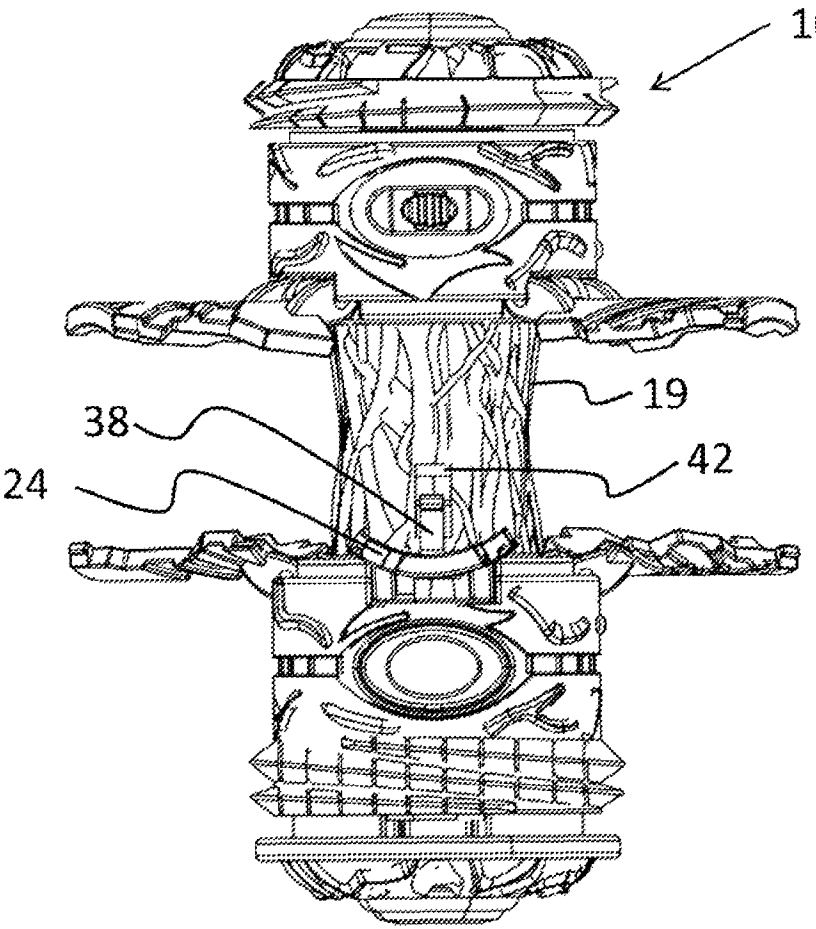
FIG. 4B is a front-view illustration of the toy, depicting the wings in a deployed state.

For further understanding of the wing action, FIG. 4A is an illustration of the spinning toy 100, with the wings (elements 14, 15, 18, 22, 23, and 24; pivoted out and away from the middle casing 19 into a deployed state. Additionally, FIGS. 4B and 4C provide front and rear-views, respectively of the spinning toy 100 with the wings in the deployed state. Notably, FIG. 4B illustrates the first wing 24 with the wing catch 38 that can be projected into the middle casing 19 (when folded against the middle casing) via a middle casing opening 42 to engage and catch against a catch lip of the wings lock cylinder.

Figure 5A:
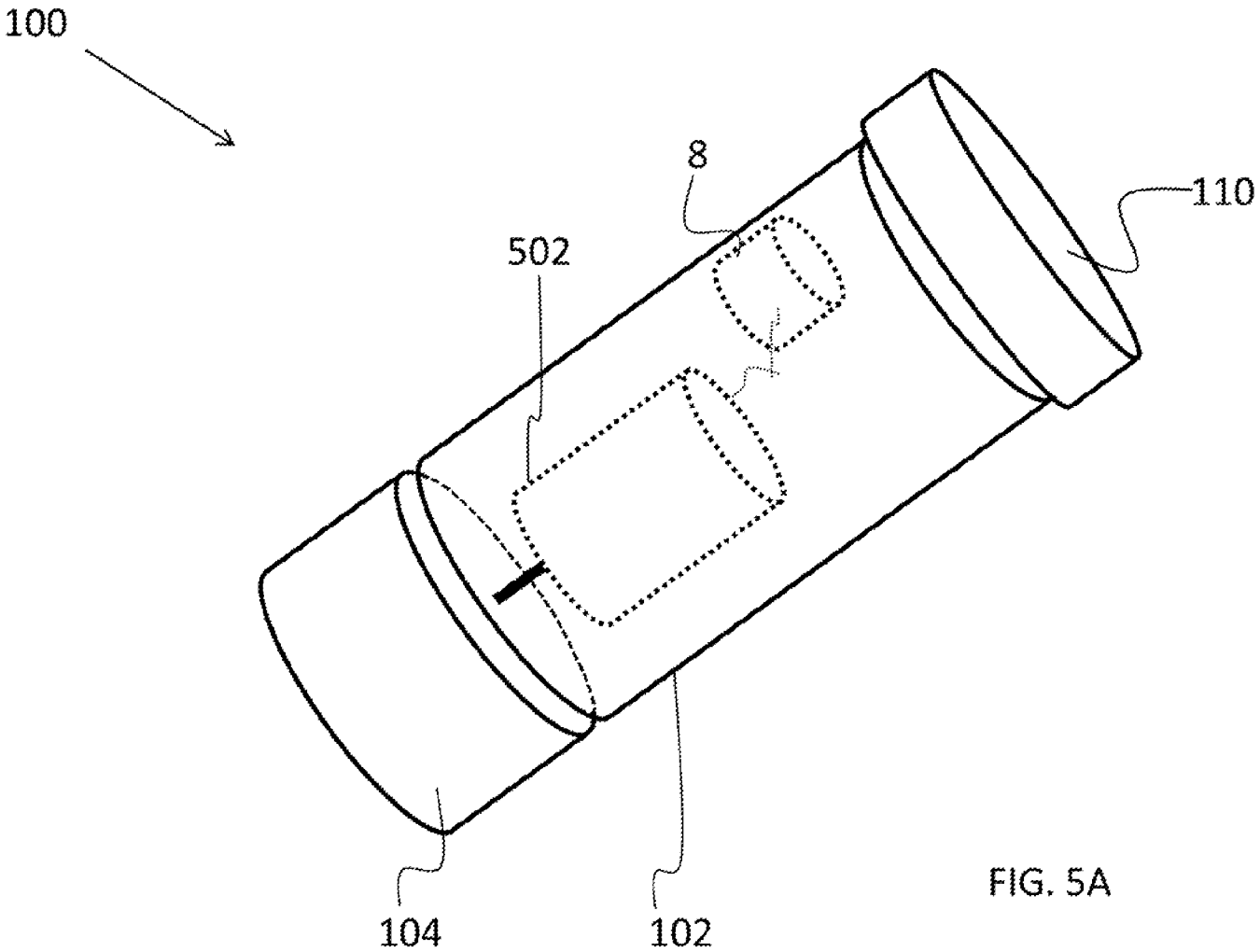
FIG. 5A is a side-view illustration of a toy according to the present invention.
Figure 5B:
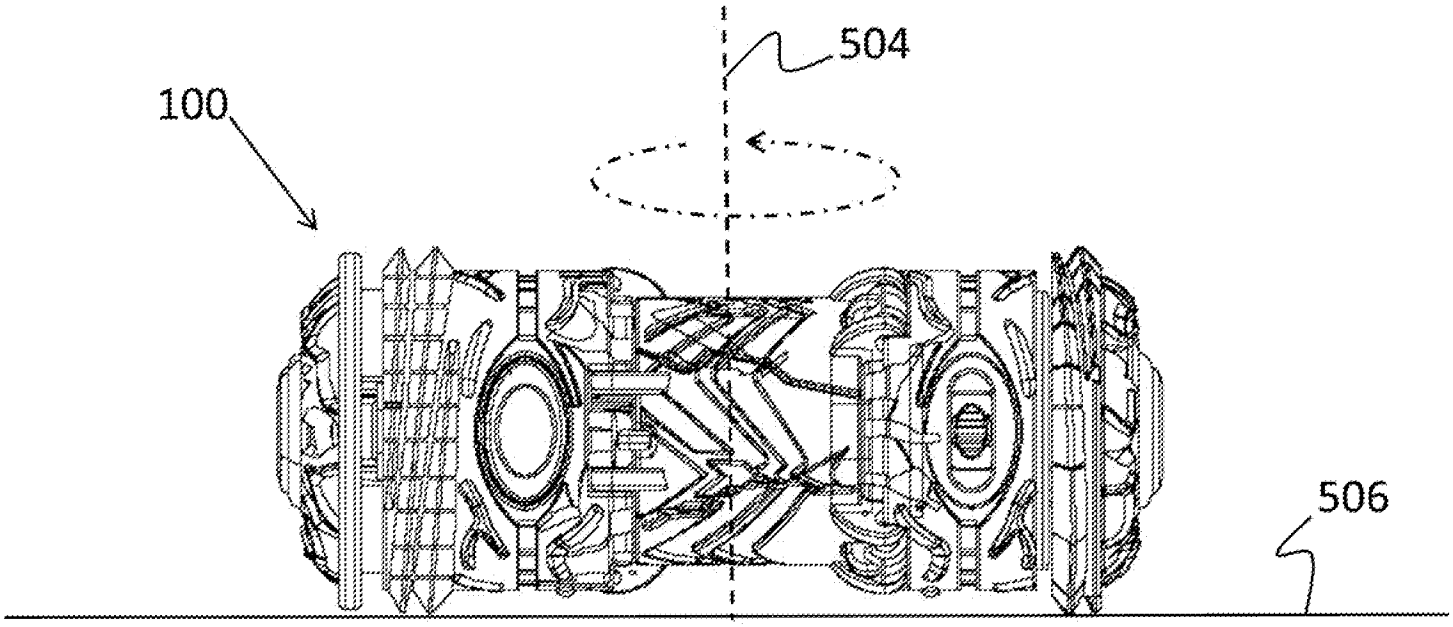
FIG. 5B is a side-view illustration of the toy according to the present invention, depicting the toy as rotating about a vertical axis.

As mentioned above and as depicted in FIG. 5A, the motor 28 is used to spin the spinning wheel 104 relative to the main part of the core (i.e., body component 102) and/or the impact trigger 10. While it could conceivably be formed so that the impact trigger 110 is rotatable, the impact trigger 110 is desirably non-rotatable with respect to the body component 102. Although the present invention is not intended to be limited thereto, in a desired aspect, the spin of the spinning wheel 104 is coaxial with the longitudinal axis of the body component 102. The effect of this action and as illustrated in FIG. 5B, is that it causes the toy 100 to spin about a vertical axis 504 when the toy 100 is placed upon a surface 506. This in effect will create a motorized spin that will last as long as the motor has power via the power source or until a switch is used to turn off the motor (e.g., via the impact trigger).

As described above and referring again to FIG. 5A, the power source 502 can be a replaceable battery. Alternatively and in another aspect, the power source 502 can be recharged through any suitable recharging mechanism. For example, a base with a power source (e.g., battery or outlet plug) can be used to plug into the toy 100 and charge the power source within the toy 100.

Figure 6:
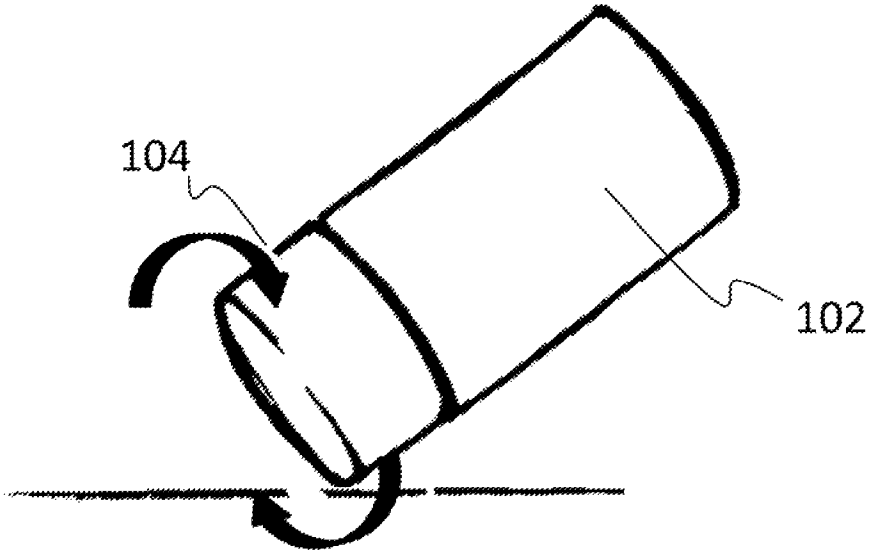
FIG. 6 a side-view illustration of the toy according to the present invention.

FIG. 6 provides an additional illustration of the toy 100 according to the present invention. As shown, the body component 102 houses the motor and batteries, which are in turn used to spin the spinning wheel 104. Optionally, the spinning wheel 104 can be formed of a material that is more dense and, therefore, heavier than the body component 102. In this aspect, the heavier spinning wheel 104 assists the spinning wheel to grasp a ground snake and spin the body component 102.

What is claimed is:

1. A spinning toy, comprising:

a body component a motor housed within the body component;

a power source housed within the body component and electrically connected with the motor; and a single spinning wheel connected with the motor and projecting from the body for causing the spinning toy to spin about a vertical axis, whereby when the motor is activated, the motor spins the spinning wheel, thereby causing the toy to spin around a vertical axis;

an impact trigger connected with the body component, wherein the spinning toy has a first end a second end opposite the first end, with the single spinning wheel being positioned at the first end and the impact trigger being positioned at the second end;

a stop mechanism that is connected with the body component and operably connected with the impact trigger; and wherein the stop mechanism includes a plurality of spring-loaded wings that are pivotally connected with the body component and a catch that is adapted to hold the wings against the body component, wherein the catch is operably connected with the impact trigger, such that upon impacting the impact trigger, the wings are released and allowed to swing outward to a deployed state; and wherein the spring-loaded wings are shaped such that when held in a closed position against the body component, the spring-loaded wings collectively form a cylindrical shape.

2. The spinning toy as set forth in claim 1, further comprising a light positioned within the body component, wherein at least a portion of the body component and wings are formed of a translucent material such that the light is visible through the wings.

3. The spinning toy as set forth in claim 2, further comprising a switch for activating the motor, the switch being a switch selected from a group consisting of a slide switch, a motion switch, and a centrifugal switch.

4. The spinning toy as set forth in claim 3, wherein the spinning wheel is formed of a material such that the spinning wheel is heavier than the body component.

5. A spinning toy, comprising:

a body component;

an impact trigger connected with the body component;

a motor housed within the body component;

a power source housed within the body component and electrically connected with the motor;

a single spinning wheel connected with the motor and projecting from the body for causing the spinning toy to spin about a vertical axis, whereby when the motor is activated, the motor spins the spinning wheel, thereby causing the toy to spin about the vertical axis;

a stop mechanism that is connected with the body component and operably connected with the impact trigger;

wherein the stop mechanism includes a plurality of spring-loaded wings that are pivotally connected with the body component and a catch that is adapted to hold the wings against the body component, wherein the catch is operably connected with the impact trigger, such that upon impacting the impact trigger, the wings are released and allowed to swing outward to a deployed state; and wherein the spring-loaded wings are shaped such that when held in a closed position against the body component, the spring-loaded wings collectively form a cylindrical shape.

* * * * *